US007447449B2

(12) United States Patent
Lu et al.

(10) Patent No.: US 7,447,449 B2
(45) Date of Patent: Nov. 4, 2008

(54) CLEANER SUBSYSTEM FAULT DETECTION

(75) Inventors: Michael Quoc Lu, Fairport, NY (US); Robert Bruce Anderson, Jr., Syracuse, NY (US); William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 134 days.

(21) Appl. No.: 11/455,970

(22) Filed: Jun. 20, 2006

(65) Prior Publication Data

US 2007/0292150 A1 Dec. 20, 2007

(51) Int. Cl.
*G03G 21/00* (2006.01)
*G03G 15/00* (2006.01)

(52) U.S. Cl. ..... 399/34; 399/71

(58) Field of Classification Search ..... 399/34, 399/71, 343, 353
See application file for complete search history.

(56) References Cited

U.S. PATENT DOCUMENTS

| | | | | |
|---|---|---|---|---|
| 5,652,945 | A * | 7/1997 | Thayer et al. | 399/34 |
| 5,771,424 | A * | 6/1998 | Lindblad et al. | 399/71 |
| 5,903,797 | A * | 5/1999 | Daniels et al. | 399/34 |
| 6,227,534 | B1 | 5/2001 | Schoedinger et al. | |
| 6,674,260 | B1 | 1/2004 | Harriman et al. | |
| 6,678,483 | B2 * | 1/2004 | Brown et al. | 399/34 |
| 6,757,638 | B2 | 6/2004 | Sokac et al. | |
| 6,775,512 | B2 | 8/2004 | Thayer | |

* cited by examiner

*Primary Examiner*—Sandra L Brase
(74) *Attorney, Agent, or Firm*—Maginot, Moore & Beck

(57) ABSTRACT

A method for detecting a stress condition in a cleaning system of an imaging device is provided. The method comprises receiving a pulse-width modulated (PWM) signal. The PWM signal has a duty cycle for driving a PWM servo motor of a cleaning system. A determination is then made whether the duty cycle of the PWM signal indicates that the servo motor is working within design limits. If the duty cycle is within design limits, characteristic adjustments of the duty cycle of the PWM are detected that indicate an occurrence of a non-catastrophic stress condition in the cleaning system. Once a characteristic adjustment of the duty cycle is detected, an alert signal is generated.

20 Claims, 5 Drawing Sheets

CLEANER SUBSYSTEM FAULT DETECTION

TECHNICAL FIELD

This invention relates generally to an image forming apparatus and more particularly, to the cleaning station for removing toner from a photoreceptor of an image forming apparatus.

BACKGROUND

In electrostatographic applications, a charge retentive surface (e.g. photoconductor, photoreceptor, or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner." Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced.

Frequently, residual toner particles adhere to the photoconductive surface after the transfer of the developed image to the copy sheet. These residual toner particles may be "right sign toner," i.e. toner particles charged to a polarity which attracts the toner particle to the latent image, or "wrong sign toner," i.e. toner particles charged to a polarity which repels the toner particle from the latent image.

A cleaning subsystem is commonly used to remove the residual toner particles from the photoconductive member. The cleaning subsystem typically includes one or more rotating cleaning brushes. Brush cleaners operate by removing the toner from the photoreceptor both with mechanical and/or electrostatic forces. The fibers on the brush touch the untransferred toner and the toner is removed from the photoreceptor onto the brush. The toner on the brush is then transported to a detoning device (e.g. flicker bar, detoning roll, air system, combs, etc.) removing the toner from the brush (i.e. detoned).

Electrostatic brush (ESB) cleaners are designed to clean right and wrong sign toner from the photoreceptor as it passes through the cleaner. Conventional electrostatic brush cleaners consist of two or more brushes electrically biased to remove toner and other debris from the photoreceptor surface. Prior to encountering the brushes, a preclean charge device adjusts the charge of the incoming toner to the natural tribo charging polarity of the toner. The first brushes are biased opposite to the polarity of the right sign toner so that this toner is removed. The last cleaning brush is biased opposite to the first brushes so that the wrong sign toner is removed. ESB cleaners typically include a housing for rotatably mounting the cleaning brushes. The housing may include an air manifold or vacuum for removing the toner from the brushes.

The brushes of an ESB cleaner are typically driven by a variable speed, pulse-width-modulated (PWM), D.C. servo motor. The cleaner servo control is commanded to turn the cleaning brushes at a predetermined velocity. The controller generates a PWM (Pulse Width Modulated) control signal to command the motor power. The typical operating range of a cleaner motor is between 55-70% of the PWM signal maximum. The speed of the cleaner servo motor may be measured with a shaft encoder that generates an electrical signal that corresponds to the rotational speed of the motor. Various factors, such as, for example, a change in the load on the cleaner motor, may cause a change in the velocity of the motor. A servo controller samples the encoder pulse output, and if the servo controller determines that the cleaner motor is operating above or below a currently commanded set point for the motor velocity, the servo controller calculates a new PWM duty cycle for the next period to adjust the cleaner servo motor velocity to the commanded velocity.

Previously known cleaning subsystems may be configured to detect when a cleaning subsystem is not working within design limits indicating that a catastrophic stress condition may have occurred within the cleaning subsystem. Typically, an indication that a cleaning subsystem is not working within design limits may be a PWM signal for controlling the cleaning motor that has reached its maximum or minimum limits. A catastrophic stress condition that may cause an adjustment of the PWM signal to its maximum or minimum limits may comprise a motor or cleaning system failure that prevents the motor from rotating the cleaning brushes at the commanded speed indicated by the PWM signal. For example, a cleaning motor or system failure may prevent the motor from rotating the cleaning brushes or may cause a dramatic increase in the load on the motor resulting in an adjustment of the PWM signal to its maximum limit (e.g. 100% duty cycle). Similarly, a cleaning motor or system failure may result in a dramatic decrease in the load on the motor such as if a cleaning brush comes uncoupled from the motor. A dramatic decrease in the load on the motor may cause an adjustment of the duty cycle of the PWM to its minimum limit (e.g. 0% duty cycle). Previously known cleaning subsystems may be configured to disable the cleaner motor and generate an alert signal for the main control system when the subsystem detects such a catastrophic stress condition.

A stress condition may occur, however, that does not cause the cleaning subsystem to work outside of the design limits for the system and may, thus, go undetected by previously known cleaning subsystems. One such non-catastrophic stress condition that may occur is an image substrate, such as a sheet of paper, remaining in contact with the photoreceptor after the transfer station so the sheet enters the cleaner housing. If this condition is not detected, the paper may get wrapped around the rotating brushes and prevent the brushes from cleaning the residual toner from the photoreceptive surface. Paper stuck in the cleaner housing may also rub against the photoreceptor and scratch the photoreceptive surface. Additionally, paper in the cleaner housing may increase the load on the cleaner servo motor driving the brushes making malfunctions of the cleaner subsystem more likely.

To minimize the chances of an image substrate getting into the cleaner housing, imaging devices have frequently contained various types of devices and techniques to strip sheets from the photoreceptor surface. For example, stripper fingers may be placed adjacent the photoreceptor to mechanically strip a sheet tacked to an image support surface before it enters the cleaner. These devices, however, are more effective with heavy stock paper than they are with light weight media. Additionally, the constant scraping action between the photoreceptor and the stripper fingers may, over time, damage the photoreceptor surface.

Another non-catastrophic stress condition that may occur at the cleaner subsystem is a photoreceptor "suck up" condition. This condition arises when the cleaner housing gets too close to the photoreceptor and the air manifold of the housing draws the photoreceptor into the housing. Consequently, the cleaner brushes are pressed against the photoreceptor surface thereby causing friction on the brushes which increases the load on the cleaner servo motor. Again, the brushes and/or housing contacting the surface of the photoreceptor may scratch and permanently damage the photoreceptor.

When a non-catastrophic stress condition occurs, residual toner particles may not be properly cleaned from the photoreceptive member. Because non-catastrophic stress conditions are typically not detected by previously known cleaning subsystems, print defects may occur in subsequent print jobs due to the residual toner particles remaining on the photoreceptor. Additionally, undetected stress conditions on the cleaning subsystem may cause damage to the photoreceptive surface, such as scratches, which may lead to streaks on the prints. Undetected stress conditions may be especially problematic during long print runs where the operator may leave the imaging device to do other tasks. As a consequence, an entire print run may be contaminated.

SUMMARY

A method for detecting a stress condition in a cleaning system of an imaging device is provided. The method comprises receiving a pulse-width modulated (PWM) signal. The PWM signal has a duty cycle for driving a PWM servo motor of a cleaning system. A determination is then made whether the duty cycle of the PWM signal indicates that the servo motor is working within design limits. A design limit may be defined as a parameter of pre-determined magnitude. In one embodiment, a design limit may comprise a duty cycle that has reached its maximum or minimum limit. If the duty cycle is within design limits, characteristic adjustments of the duty cycle of the PWM are detected that indicate an occurrence of a non-catastrophic stress condition in the cleaning system. Once a characteristic adjustment of the duty cycle is detected, an alert signal is generated. In response to the alert signal generated, imaging operations may be halted.

In another embodiment, a cleaning system of an imaging device is provided comprising a servo motor cleaner motor with PWM signal for rotating one or more cleaning brushes, the cleaner motor having an encoder for providing a feedback signal corresponding to an actual speed of the cleaner motor. The cleaning system includes a controller for driving the servo motor that has a PWM generator for generating a motor PWM signal having a duty cycle for driving the servo motor at a set point motor speed and a PWM monitor for monitoring the motor PWM signal. The PWM generator is configured to adjust the duty cycle of the PWM signal based on the feedback signal to maintain the actual motor speed at the set point speed. The PWM monitor is configured to detect a characteristic adjustment of the duty cycle of the PWM signal that is within design limits of the servo motor and that indicate an occurrence of a stress condition in the cleaning system and to generate an alert signal upon detection of the characteristic adjustment.

In yet another embodiment, a method for a cleaning system of an imaging device comprises generating a PWM signal having a duty cycle for driving a PWM servo motor of a cleaning system at a set point speed. The duty cycle of the PWM signal is adjusted to maintain an actual speed of the motor at the set point speed. Characteristic adjustments of the duty cycle that are within design limits of the PWM servo motor are detected, the characteristic adjustments indicating an occurrence of a non-catastrophic stress condition on the cleaning system. An alert signal may then be generated upon detection of the characteristic adjustment.

BRIEF DESCRIPTION OF THE DRAWINGS

Aspects and features of the present embodiments will become apparent as the following description proceeds and upon reference to the drawings, in which.

DETAILED DESCRIPTION OF THE PREFERRED EMBODIMENT

Figure 1:
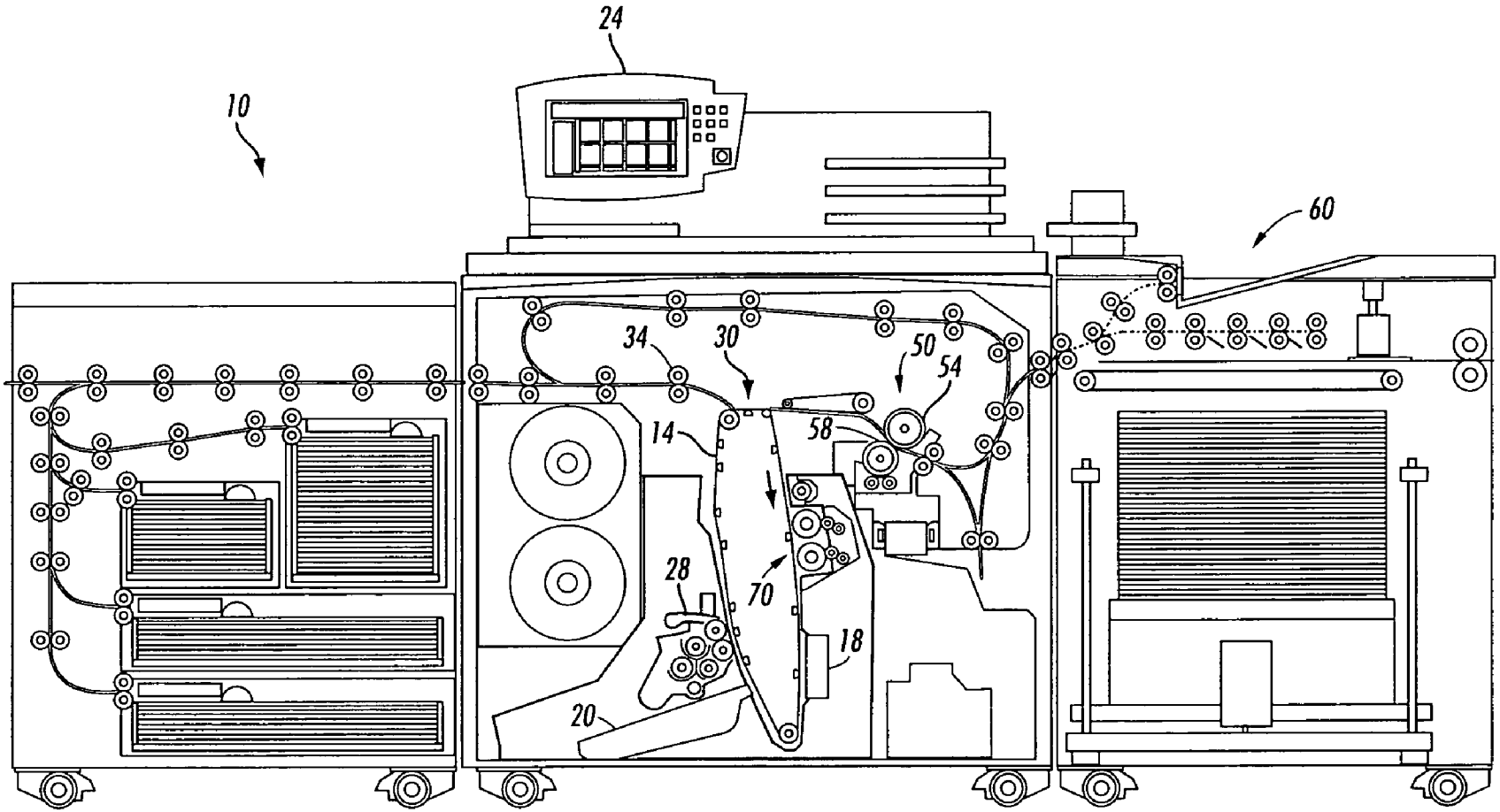
FIG. 1 is a schematic elevational view of an illustrative electrostatographic machine.

For a general understanding of the present embodiments, reference is made to the drawings. In the drawings, like reference numerals have been used throughout to designate like elements.

Moving now to a description of FIG. 1, the exemplary electrostatographic machine 10 employs an image-retentive member, such as photoreceptor belt 14. The belt 14 includes a photoconductive surface deposited on an electrically grounded conductive substrate. Photoreceptor 14 continuously travels the circuit depicted in the figure in the direction indicated by the arrow advancing successive portions of the photoconductive surface of the belt 14 through various processing stations, disposed about the path of movement thereof, as will be described. While a photoreceptor belt 14 is shown, it is to be understood that other types of image-retentive members could be used, such as an intermediate belt or drum used in a color electrophotographic machine, offset printing apparatus, or ink-jet printer.

Initially, a segment of belt 14 passes through charging station 18. At charging station 18, a corona generating device (not shown) or other charging apparatus, charges photoreceptor belt 14 to a relatively high, substantially uniform potential. Once charged, the photoreceptor belt 14 is advanced to imaging station 20.

At imaging station 20, a raster output scanner (ROS) (not shown) discharges selectively those portions of the charge corresponding to the image portions of the document to be reproduced. In this way, an electrostatic latent image is recorded on the photoconductive surface. An electronic subsystem (ESS) (not shown) controls the ROS. The ESS is adapted to receive signals from a system controller 24 and transpose these signals into suitable signals for controlling the ROS so as to record an electrostatic latent image corresponding to the document to be reproduced by the printing machine 10. Other types of imaging systems may also be used employing, for example, a pivoting or shiftable LED write bar or projection LCD (liquid crystal display) or other electro-optic display as the "write" source.

After the electrostatic latent image is recorded on photoconductive surface of belt 14, belt 14 advances to development station 28 where toner material is deposited onto the electrostatic latent image. In the development station 28, toner particles are mixed with carrier beads, generating an electrostatic charge therebetween which causes the toner particles to cling to the carrier beads to form developing material. The developing material is brought into contact with the photoreceptor belt 14 such that the latent image thereon attracts the toner particles from the developing material to develop the latent image into a visible image.

After the toner particles have been deposited onto the electrostatic latent image for creating a toner image thereof, belt 14 becomes an image bearing support surface for advancing the developed image to transfer station 30. At transfer station 30, a print substrate (not shown) is moved into contact with the developed toner image via registration subsystem 34. At transfer station 30, a corona generating device (not shown) charges the print sheet to the proper magnitude and polarity in order to establish a transfer field that is effective to tack the print sheet to photoconductive belt 14 and to attract the developed image from the photoconductive belt 14 to the print sheet.

After transfer, a corona generator (not shown) charges the print sheet with an opposite polarity to detack the print sheet, whereupon the sheet is stripped from belt 14. The substrate is subsequently separated from the belt 10 and transported to a fusing station 50. The toner image is thereby forced into contact with the substrate between fuser rollers 54 and 58 to permanently affix the toner image to substrate. After fusing, the print substrate is advanced to receiving tray 60 for subsequent removal by an operator.

Invariably, after the print substrate is separated from belt 14, some residual developing material remains adhered to the photoconductive surface of the belt 14. Thus, a final processing station, namely, cleaning station 70, is provided for removing residual toner particles from photoreceptor belt 14.

The various machine functions are regulated by a system controller 24 having a user interface. The controller 24 is preferably a programmable microprocessor that controls all of the machine functions hereinbefore described. The controller 24 may be programmed to monitor various operating parameters of the electrostatographic machine such as print substrate type, the number of documents being re-circulated, the number of print sheets selected by the operator, time delays, and jam indications, among other various functions including transfer assist actuation. Conventional sheet path sensors or switches may be utilized to keep track of the types and position of documents and print substrates in the machine. The operation of all of the exemplary systems described hereinabove may be accomplished by conventional user interface control.

The foregoing description should be sufficient for purposes of illustrating the general operation of an electrostatographic printing machine incorporating an exemplary embodiment of an apparatus for reducing transfer deletions. As described, an electrostatographic printing machine may take the form of any of several well known devices or systems. Variations of specific electrostatographic processing subsystems or processes may be expected without affecting the operation of the exemplary embodiment.

Figure 2:
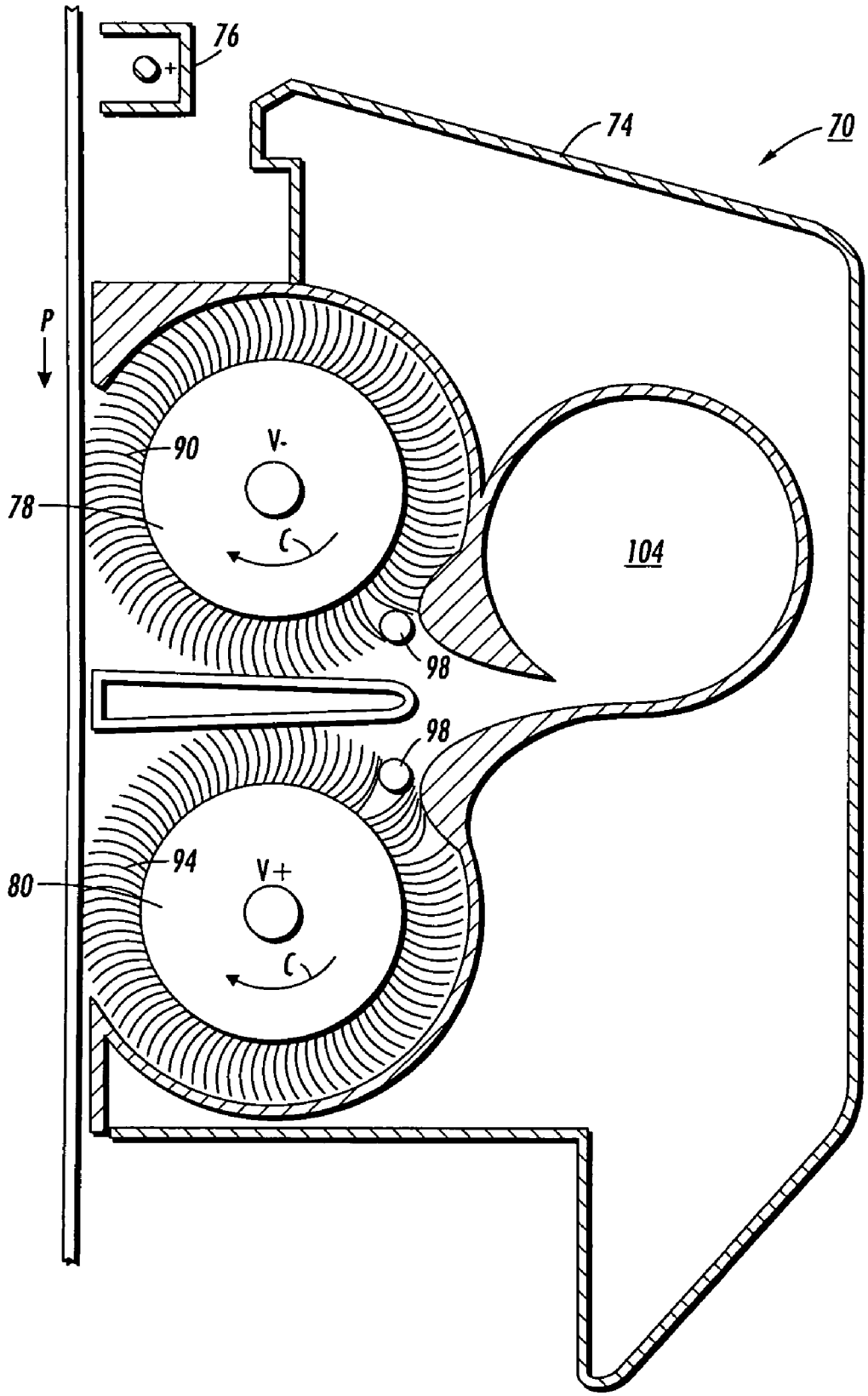
FIG. 2 is side cross-sectional elevational view of a cleaning system of the electrostatographic machine of FIG. 1.

Turning now to FIG. 2, an embodiment of the cleaning station 70 is shown in more detail. In the embodiment, the cleaning station 70 comprises a dual electrostatic brush (DESB) cleaning brush system, although any suitable type of cleaning station may be used. Cleaning station 70 includes dual electrostatic brushes 78, 80 rotatably mounted in a housing 74. The DESB cleaner 70 removes toner from the photoreceptor 14 with both mechanical and electrostatic forces. The brushes 78, 80 are rotated by the motor 84 in the direction indicated by arrow C. The fibers 90, 94 on the brushes 78, 80 mechanically dislodge residual toner particles from the photoreceptor 14, moving in the direction of arrow P, and electrostatically hold the toner particles onto the fibers 90, 94. Each of the two brushes is provided a DC bias (not shown). The first brush 90 is biased to attract toner from the photoreceptor of the dominant polarity, or "right sign toner." The second brush 94 is reverse biased so as to attract the relatively small quantity of toner particles of opposite polarity commonly known as "wrong sign toner."

The particles removed from the photoreceptor surface 14 that adhere to the brush fibers 90, 94 may be removed from the brush fibers by any suitable method. In one embodiment, the toner particles are removed from the brush fibers when the fibers contact a protruding flicker bar edge 98. The flicker bar 98 dislodges the toner and other debris particles held in the brush fibers as the brush is rotating. An air passage carries the dislodged toner particles to an air manifold 104 which has a vacuum (not shown) on its opposite end creating the air flow that moves the particles away from the brush fibers 90, 94.

Figure 3:
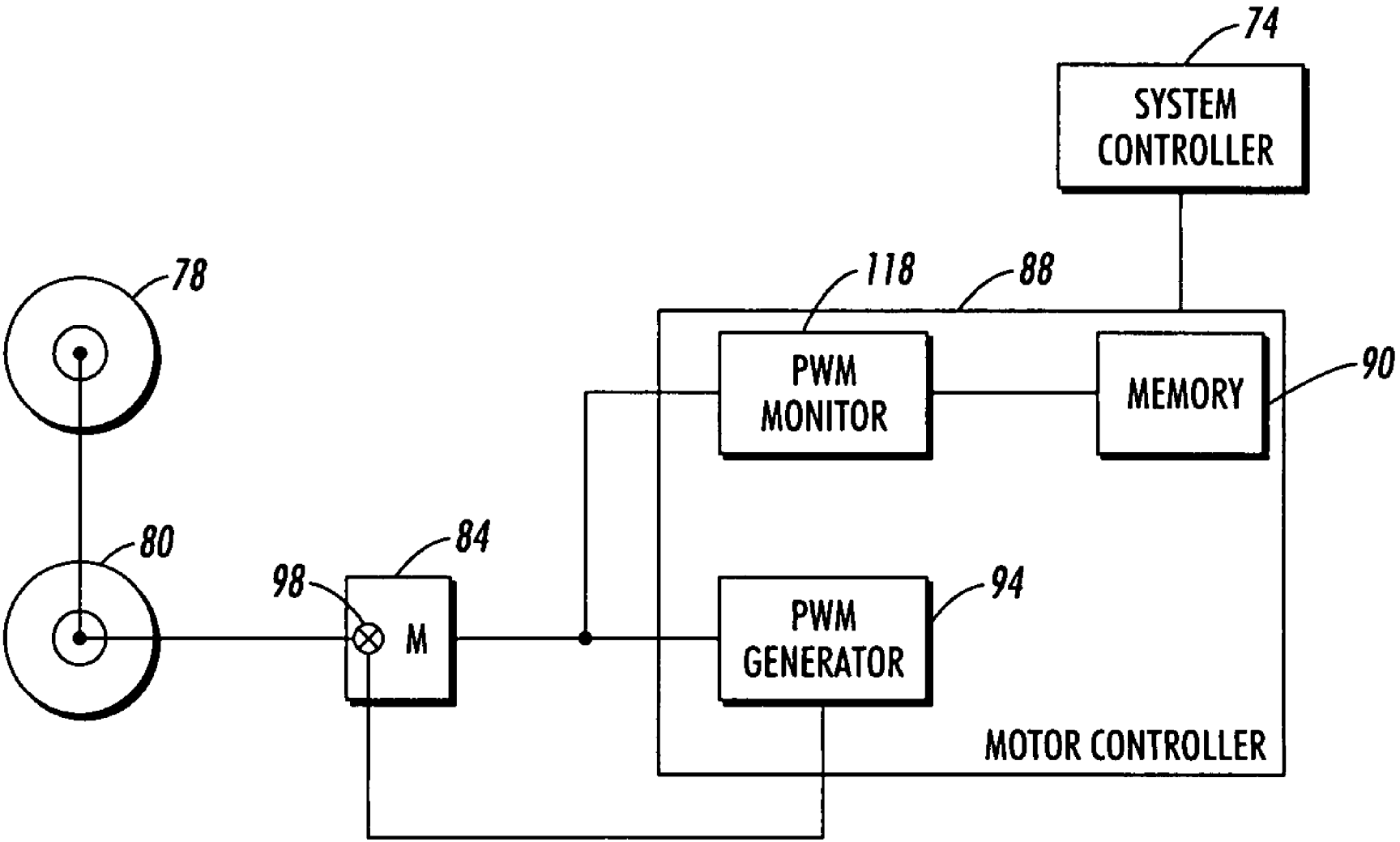
FIG. 3 is schematic view of the cleaning system of FIG. 2.

Referring now to FIG. 3, the cleaner brushes 78, 80 are driven by a cleaner motor 84. In the embodiment of FIG. 3, the cleaner motor 84 comprises a variable speed, pulse-width-modulated (PWM), servo motor. The cleaner motor 84 may be any suitable type of D.C. servo motor such as, for example, a permanent magnet or shunt-field type servo motor. Cleaner motor 84 is operably connected to and controlled by a cleaner motor controller 88. The motor controller may be implemented in hardware, software, or some combination thereof, and may be integrated with other function elements or implemented as a stand alone circuit.

Motor controller 88 includes memory 90. The memory 90 may be a non-volatile memory such as a read only memory (ROM) or a programmable non-volatile memory such as an EEPROM or flash memory. Of course, memory 90 may be incorporated into the motor controller 88 as shown, or may be externally located. Memory 90 may include parameters stored therein which correspond to reference PWM values of the cleaner motor. The reference PWM values may comprise PWM values that correspond to the set point velocity of the cleaner motor. The set point reference PWM values may be pre-programmed into memory 90 in the motor controller 88, hard-coded into a software program or acquired by monitoring the motor PWM during normal operating conditions. Additionally, reference PWM values that correspond to threshold values of the cleaner motor such as the upper and lower design limits as well as upper and lower limits of the expected operating range of cleaner motor may be stored or programmed into the memory 90. These values may be stored in a data structure, such as a lookup table, in the memory 90.

Cleaner motor controller 88 controls the operation of cleaner motor 84 and in turn controls movement of cleaning brushes 78, 80 in response to an actuation signal from the main controller 24. In response to the actuation signal, the motor controller drives the cleaner motor, and, consequently, the cleaner brushes, at a commanded or set point motor speed. The set point speed may be supplied by the main controller 24. Alternatively, the motor controller may be programmed with the set point motor speed. In one embodiment, the motor controller generates a PWM signal having a duty cycle calculated to drive the cleaner motor at the set point speed. The motor controller may receive feedback from the cleaner motor indicating that the motor is operating above or below the set point speed. Based on the feedback, the motor controller may vary the duty cycle of the PWM control signal to adjust the cleaner motor velocity to the set point velocity.

Thus, in one embodiment, the motor controller includes a PWM generator 94 and a feedback comparator. The PWM generator 94 is configured to generate a PWM signal with a duty cycle for driving the cleaner motor at the set point speed. The PWM 94 generator may be implemented through software or firmware running on the motor controller or main system controller. Alternatively, the PWM generator may be implemented in hardware in the motor controller.

As motor 84 turns in response to the PWM signal generated by PWM generator 94, an encoder 98 generates a feedback signal that indicates actual motor speed. Encoder 98 may comprise a photo-interrupter based encoder circuit that generates output pulses at a frequency related to the motor's rotational speed. Although an encoder is illustrated, other position sensors and position sensing methods may be used, including, but not limited to, resolvers, back-EMF sensing methods, potentiometers, and position sensors using magnetic field sensing such as hall-effect devices. The feedback comparator receives the speed feedback signal from encoder 98 as one input and receives a reference (commanded or set point speed) signal as a second input. An error signal output by feedback comparator indicates error between actual and set point speed, and thus serves as a control input to PWM generator. Based on the error signal from the feedback comparator, PWM generator may adjust the duty cycle of the PWM signal to the motor 84 in order to maintain the actual motor speed at the set point speed. For example, the duty cycle of the PWM signal may be increased to increase the actual motor speed, and the duty cycle may be decreased to decrease the actual motor speed.

During normal operations of the cleaning system, the motor controller 88 may not have to substantially vary the PWM control signal away from a nominal value to maintain the set point motor speed while driving cleaner motor 84. A catastrophic stress condition, however, may result in a dramatic adjustment of the duty cycle of the PWM signal that goes beyond the design limits of the cleaner motor. For instance, a catastrophic stress condition, such as, for example, a system or hardware malfunction that prevents the motor from turning, may result in the PWM signal reaching a saturation level (100% duty cycle). Additionally, a sudden or instantaneous loss of load caused by, for example, the cleaning brushes coming uncoupled or sheared from the output shaft of the motor, may result in sudden extreme increase in the actual motor speed that causes an adjustment of the PWM duty cycle to be 0%. Thus, a catastrophic stress condition may be detected by monitoring the PWM signal to detect occurrences of duty cycles of 0% or 100%.

A stress condition on the cleaning system that is not catastrophic may also affect the cleaner motor's ability to respond to the PWM signal albeit without causing the PWM signal to reach catastrophic stress level indicators (0% or 100% PWM). A stress condition that is not catastrophic may result in characteristic adjustments of the PWM signal within the design limits of the motor. For instance, a stress condition on the cleaning system may result in an adjusted PWM duty cycle that, while not beyond design limits of the cleaner motor, is outside of the expected operating range of the PWM signal. For electrostatic imaging devices, the cleaner motor 84 typically functions within a given operating range under normal operating conditions. The expected operating range of the cleaner motor PWM under normal operating conditions may comprise a duty cycle of between 55% and 70% PWM. A stress condition may be indicated by an adjusted PWM duty cycle that is outside the expected operating range but within the design limits of the cleaner motor PWM, i.e. greater than 0% and less than 55% PWM as well as greater than 70% and less than 100% PWM.

Additionally, a stress condition on the cleaner system may result in an aberrant adjustment of the duty cycle of the PWM signal. For instance, an aberration in the duty cycle of the PWM signal may comprise a sudden increase or decrease in the duty cycle of the PWM from a nominal value of the duty cycle. For example, a paper that remains tacked to the photoreceptor and enters the cleaner housing may cause a sudden increase in the load on the cleaner motor as the paper initially comes into contact with the cleaner brushes. The sudden increase in load may cause a sudden or abrupt increase in the duty cycle of the PWM from a nominal value to adjust for the increased load.

Figure 4:
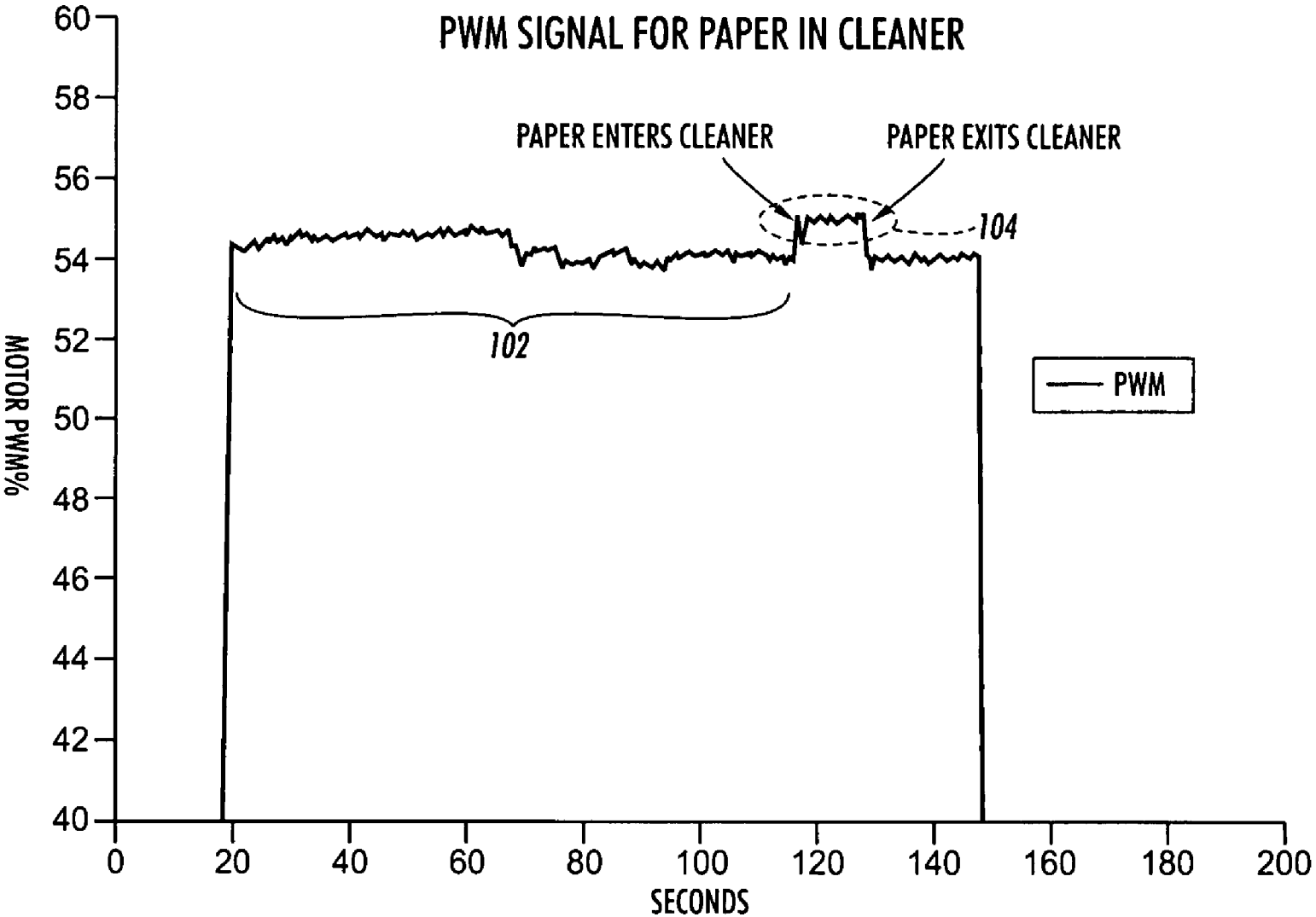
FIG. 4 is a graph of a PWM curve for controlling the operation of a cleaner motor.

FIG. 4 shows a graph of the duty cycle of a PWM control signal output by a cleaner motor controller over time. The vertical axis illustrates a PWM control signal duty cycle, and the horizontal axis depicts time. The first portion 102 of the curve represents a baseline duty cycle of the PWM when the motor is running under normal conditions. The second portion 104 of the curve illustrates the motor PWM under a stress condition in which a piece of paper has gotten into the cleaner housing. As shown in FIG. 4, the increased load on the cleaner motor caused by the paper getting into the cleaner housing is illustrated by the sudden or abrupt change from the baseline duty cycle 102 to the duty cycle shown in the second portion 104 of the graph.

Thus, a stress condition that is not catastrophic may be detected by monitoring the motor PWM to determine if the PWM signal is within design limits and detecting characteristic adjustments of the PWM duty cycle that, while within design limits, indicates the occurrence of a stress condition. A characteristic adjustment indicating a stress condition other than catastrophic may comprise an adjustment of the duty cycle to be outside the expected operating range of the cleaner motor but within the design limits. Additionally, a characteristic adjustment may comprise an aberrant adjustment in the duty cycle of the PWM within the expected operating range.

Thus, referring again to FIG. 3, the motor controller may include a PWM monitor 118 for monitoring the duty cycle of the motor PWM output by the PWM generator to detect characteristic adjustments of the duty cycle that may indicate the occurrence of a non-catastrophic stress condition and generating an alert signal in response to the detection of a characteristic adjustment of the duty cycle. To this end, the PWM monitor is configured to determine if the duty cycle of the PWM indicates that the motor power is within design limits but outside the expected operating range. Additionally, the PWM monitor may be configured to detect aberrant adjustments of the PWM duty cycle within the expected operating range that may indicate a stress condition, such as, for example a sudden increase or decrease in the duty cycle of the PWM signal. The PWM monitor 118 may be implemented in hardware, software, or some combination thereof, and may be integrated with other function elements or implemented as a stand alone circuit. The PWM monitor 118 may have access to the reference PWM values corresponding to the nominal PWM values and threshold PWM values that are stored in memory 90.

The PWM monitor may compare the monitored PWM values to the set point and threshold reference PWM values to determine if the duty cycle of the PWM is within operating limits and/or within the expected operating range of the cleaner motor. If the PWM monitor determines that the duty cycle of the PWM is not within design limits, the PWM monitor may generate an alert signal indicating a catastrophic stress condition.

Similarly, if the PWM monitor determines that the duty cycle of the PWM is within design limits but outside the expected operating range or detects aberrant adjustments to the duty cycle that may indicate a stress condition, the PWM monitor may generate an alert signal indicating a non-catastrophic stress condition. Aberrant adjustments of the PWM signal may be detected, for example, by comparing the current PWM duty cycle detected to a previous PWM duty cycle and calculating the increase in the duty cycle over a unit of time (ΔPWM/Δt). To compensate for fluctuations that may occur during normal operations, the PWM monitor may be configured to only generate an alert signal in response to sudden increases or decreases that are greater than a pre-selected magnitude or that occur for longer than a pre-selected duration.

The alert signals generated by the PWM monitor may be received by the main controller 24. An alert signal may take any form suitable to indicate the occurrence of a stress condition to the controller 24. For example, an alert signal may comprise an electric signal of a pre-determined value. In one embodiment, an alert signal may comprise an electronic message such as, for example, an email, or the like, that may be sent over a network. The controller 24, in receipt of the alert signal indicating a type of stress condition, may take appropriate action such as, for example, halting operations of the imaging device and issuing an alert by displaying a message, light, emitting an audio alert, etc., indicating that the cleaning system requires servicing. As mentioned above, a stress condition on the cleaning system may cause defects in imaging operations as well as damage to equipment. By halting operations upon detection of a stress condition, print defects may be prevented in subsequent prints. Additionally, damage to equipment may be limited by halting operations as soon a stress condition is detected.

Figure 5:
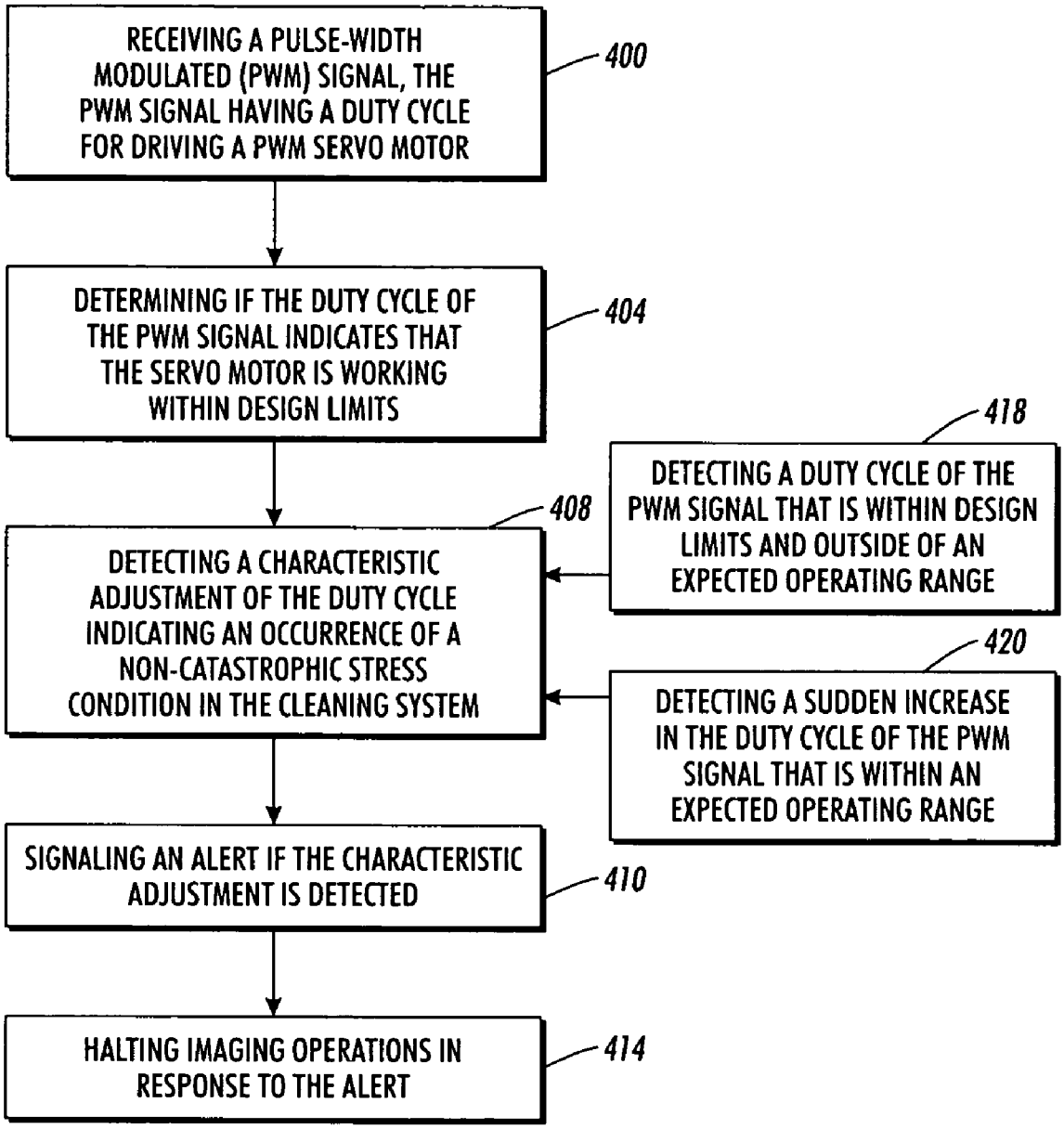
FIG. 5 is a flowchart for a method of detecting a stress condition on a cleaning system of the machine of FIG. 1.

FIG. 5 is a flow chart illustrating a fault detection scheme for detecting a stress condition in a cleaning system of an imaging device. A method for detecting a stress condition in a cleaning system of an imaging device is provided. The method comprises receiving a pulse-width modulated (PWM) signal (block 400). The PWM signal has a duty cycle for driving a PWM servo motor of a cleaning system. A determination is then made whether the duty cycle of the PWM signal indicates that the servo motor is working within design limits (block 404). If the duty cycle is within design limits, characteristic adjustments of the duty cycle of the PWM are detected that indicate an occurrence of a non-catastrophic stress condition in the cleaning system (block 408). Once a characteristic adjustment of the duty cycle is detected, an alert signal is generated (block 410). In response to the alert signal generated, imaging operations may be halted (block 414).

In one embodiment, detecting a characteristic adjustment of the duty cycle indicating an occurrence of a non-catastrophic stress condition in the cleaning system comprises detecting a duty cycle of the PWM signal that is within design limits and outside of an expected operating range (block 418). The expected operating range of the duty cycle of the PWM signal may be between 55-70%. In another embodiment, detecting a characteristic adjustment of the duty cycle indicating an occurrence of a non-catastrophic stress condition in the cleaning system comprises detecting a sudden increase in the duty cycle of the PWM signal that is within an expected operating range (block 420). The alert signal may be generated if the sudden increase in the duty cycle of the PWM signal is greater than a pre-selected magnitude and/or greater than a pre-selected duration.

Those skilled in the art will recognize that numerous modifications can be made to the specific implementations described above. Those skilled in the art will recognize that the electrostatographic imaging device may take the form of any of several known devices or systems. Variations of specific electrostatographic processing subsystems or processes are contemplated within the scope of this disclosure. Moreover, although xerographic imaging devices are described in the embodiments, the claimed invention is applicable to other types of printing as well, such as offset, ink-jet printing, or the like, in which one or more layers of ink/toner are built up on a surface before being transferred to paper. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method for cleaning material from an imageable surface of an imaging device, the method comprising:

receiving a pulse-width modulated (PWM) signal, the PWM signal having a duty cycle for driving a PWM servo motor of a cleaning system;

determining if the duty cycle of the PWM signal indicates that the servo motor is working within design limits;

if the duty cycle is within design limits, detecting a characteristic adjustment of the duty cycle indicating an occurrence of a non-catastrophic stress condition in the cleaning system; and signaling an alert if the characteristic adjustment is detected.

2. The method of claim 1, wherein detecting a characteristic adjustment of the duty cycle indicating an occurrence of a non-catastrophic stress condition in the cleaning system comprises:

detecting a duty cycle of the PWM signal that is within design limits and outside of an expected operating range.

3. The method of claim 2, wherein the expected operating range of the duty cycle of the PWM signal is between 55-70%.

4. The method of claim 3, wherein detecting a characteristic adjustment comprising a sudden increase in the duty cycle of the PWM signal that is within an expected operating range comprises:

comparing a current value of the duty cycle of the PWM signal to a previous value of the duty cycle of the PWM signal;

detecting a sudden increase of the duty cycle of the PWM signal if the current value is greater than the previous value by a pre-selected magnitude.

5. The method of claim 1, wherein detecting a characteristic adjustment of the duty cycle indicating an occurrence of a non-catastrophic stress condition in the cleaning system comprises:

detecting a sudden increase in the duty cycle of the PWM signal that is within an expected operating range.

6. The method of claim 5, wherein signaling an alert if the characteristic adjustment is detected comprises:

signaling an alert if the sudden increase in the duty cycle of the PWM signal is greater than a pre-selected magnitude.

7. The method of claim 5, wherein signaling an alert if the characteristic adjustment is detected comprises:

signaling an alert if the sudden increase in the duty cycle of the PWM signal is greater than a pre-selected duration.

8. The method of claim 1, further comprising:

halting imaging operations in response to the alert.

9. A cleaning system of an imaging device, the system comprising:

a PWM servo motor cleaner motor for rotating one or more cleaning brushes, the cleaner motor having an encoder for providing a feedback signal corresponding to an actual speed of the cleaner motor;

a controller for driving the PWM motor, the cleaner motor controller including:

a PWM generator for generating a motor PWM signal having a duty cycle for driving the PWM servo motor at a set point motor speed;

a PWM monitor for monitoring the motor PWM signal;

wherein the PWM generator is configured to adjust the duty cycle of the PWM signal based on the feedback signal to maintain the actual motor speed at the set point speed; and wherein the PWM monitor is configured to detect a characteristic adjustment of the duty cycle of the PWM signal that is within design limits of the servo motor and that indicate an occurrence of a stress condition in the cleaning system and to generate an alert signal upon detection of the characteristic adjustment.

10. The cleaning system of claim 9, wherein the characteristic adjustment comprises a duty cycle of the PWM signal that is within design limits and outside of an expected operating range.

11. The cleaning system of claim 10, wherein the expected operating range of the duty cycle of the PWM signal is between 55-70%.

12. The cleaning system of claim 9, wherein the characteristic adjustment comprises a sudden increase in the duty cycle of the PWM signal that is within an expected operating range.

13. The cleaning system of claim 12, wherein the PWM monitor is configured to detect the sudden increase in the duty cycle by comparing a current value of the duty cycle of the PWM signal to a previous value of the duty cycle of the PWM signal.

14. The cleaning system of claim 13, wherein the PWM is configured to generate the alert if the sudden increase in the duty cycle of the PWM signal is greater than a pre-selected magnitude.

15. The cleaning system of claim 13, wherein the PWM is configured to generate the alert if the sudden increase in the duty cycle of the PWM signal is greater than a pre-selected duration.

16. The cleaning system of claim 13, wherein the cleaning system includes a controller, the controller being configured to halt imaging operations in response to the alert.

17. The system of claim 9, wherein a stress condition comprises an image substrate getting into a cleaner housing of the cleaning system.

18. The system of claim 9, wherein a stress condition comprises a photoreceptor "suck up" condition.

19. A method for a cleaning system of an imaging device, the method comprising:

generating a PWM signal having a duty cycle for driving a PWM servo motor of a cleaning system at a set point speed;

adjusting the duty cycle of the PWM signal to maintain an actual speed of the motor at the set point speed;

detecting a characteristic adjustment of the duty cycle that is within design limits of the PWM servo motor that indicates an occurrence of a non-catastrophic stress condition on the cleaning system; and generating an alert signal upon detection of the characteristic adjustment.

20. The method of claim 19, wherein detecting a characteristic adjustment comprises:

detecting a sudden increase in the duty cycle of the PWM signal of a predetermined magnitude and duration.

* * * * *